US009923327B2

(12) United States Patent
Packebusch et al.

(10) Patent No.: US 9,923,327 B2
(45) Date of Patent: Mar. 20, 2018

(54) EXCHANGEABLE CRIMPING DIE INSERT FOR A CRIMPING DIE

(71) Applicant: DELPHI TECHNOLOGIES, INC., Troy, MI (US)

(72) Inventors: Swindhard Packebusch, Wuppertal (DE); Frank Ochse, Wuppertal (DE)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/278,169

(22) Filed: Sep. 28, 2016

(65) Prior Publication Data

US 2017/0093108 A1 Mar. 30, 2017

(30) Foreign Application Priority Data

Sep. 28, 2015 (EP) ..... 15187221

(51) Int. Cl.
*H01R 43/058* (2006.01)
*B25B 27/10* (2006.01)
*H01R 43/048* (2006.01)

(52) U.S. Cl.
CPC ..... *H01R 43/058* (2013.01); *B25B 27/10* (2013.01); *H01R 43/048* (2013.01)

(58) Field of Classification Search
CPC ..... H01R 43/058; H01R 43/048; B25B 27/10
USPC ..... 72/413
See application file for complete search history.

(56) References Cited

U.S. PATENT DOCUMENTS

| | | | | |
|---|---|---|---|---|
| 2,635,494 | A | 4/1953 | Rogoff | |
| 2,837,135 | A | 6/1958 | Demler | |
| 4,118,971 | A | 10/1978 | Izraeli | |
| 5,323,634 | A * | 6/1994 | Wolfe | B21J 13/00 29/753 |
| 7,024,752 | B2 * | 4/2006 | Imgrut | H01R 43/0486 29/448 |
| 2005/0050940 | A1 | 3/2005 | Ishizuka et al. | |

FOREIGN PATENT DOCUMENTS

| | | | |
|---|---|---|---|
| DE | 4427306 | A1 | 2/1996 |
| EP | 570885 | A1 | 11/1993 |
| EP | 1081810 | A1 | 3/2001 |
| EP | 1503454 | A1 | 2/2005 |

* cited by examiner

*Primary Examiner* — David B Jones
(74) *Attorney, Agent, or Firm* — Robert J. Myers

(57) ABSTRACT

The present invention refers to an exchangeable crimping die insert for a crimping die for crimping electrical contact terminals to electrical cables. The exchangeable crimping die insert includes a first and second crimp profile integrated in one part, the first crimp profile having an essentially identical profiles with the second crimp profile. Furthermore, the exchangeable crimping die insert includes an indicator to differentiate the first crimp profile from the second crimp profile.

13 Claims, 10 Drawing Sheets

EXCHANGEABLE CRIMPING DIE INSERT FOR A CRIMPING DIE

CROSS-REFERENCE TO RELATED APPLICATION

This application claims the benefit under 35 U.S.C. § 119(a) of Patent Application No. 15187221.5 filed in the European Patent Office (EPO) on Sep. 28, 2015, the entire disclosure of which is hereby incorporated by reference.

TECHNICAL FIELD OF THE INVENTION

The present invention refers to an exchangeable crimping die insert for a crimping die, and in particular to an exchangeable crimping die insert for a crimping die having several identical crimp profiles integrated in one part.

BACKGROUND OF THE INVENTION

Crimping is extensively used for joining two pieces of metal or other ductile materials by deforming one or both pieces. For example, in the automotive industry, the crimping technique has replaced soldering to a large extent. In an exemplary crimping process a stripped wire is inserted in correctly sized crimping vanes of a terminal, and a crimping tool or a crimping die is used to tightly squeeze the crimping vanes of the terminal against the wire. In order to fulfil predetermined requirements for a crimped product, the terminal, the crimping material, for example the stripped wire, and a crimping tool have to be tailored to each other. For this purpose, crimping tools or crimping dies have specific crimp profiles adapted to specific terminals and crimping materials.

European Patent Application EP 1503454 A1 describes a typical crimping process for joining a contact terminal to a respective electrical wire for generating wire harnesses used in vehicles. U.S. Patent Application Publication 2005/0050940 A1 describes an example of a crimping tool as it is applied in automated mass production.

As already mentioned, the crimping die has to deform in a defined manner at least one of the two components to be combined in the joining process, typically the terminal. This means that usually the material of the crimping tool has to be harder than the material of both the materials to be joined. In order to increase the lifetime of the crimping die, these tools preferably have an exchangeable or changeable crimping die insert of hard material, preferably a hard metal or a hard metal alloy. Nevertheless, exchangeable crimping die inserts wear off rapidly during thousands or hundreds of thousands of crimping processes performed by a crimping die or crimp tool designed for mass production. Hence, the crimping die insert is a wearing part. The usage of the crimping tool for many joining processes gradually changes the crimp profile of the crimping die insert. This may lead to the result that the crimped product does no longer meet predetermined requirements with respect to the reliability and/or durability. Therefore, it is necessary to periodically replace the crimping die insert, i.e. after having performed a predetermined number of crimps.

To optimize the lifetime of a crimping die insert, it would be beneficial that a crimping die insert has more than one identical crimp profile. For example, in case a crimping die insert has two identical crimp profiles, the lifetime of the crimping die would double. The German patent application DE 4427306 A1 describes an exchangeable contour insert for an automated strand placement machine, wherein the exchangeable contour insert includes two identical crimp profiles arranged on the top and bottom face of the contour insert.

However, the two identical crimp profiles of DE 4427306 A1 are integrated in an exchangeable contour insert carry the risk that one of the crimp profiles is excessively used, whereas the other one is hardly used. This may occur, since it is difficult to determine the degree of wear and tear of several identical crimp profiles of an exchangeable crimping die insert. In particular, it is not possible to reliably identify the condition of a crimp profile with the naked eye, so that it is not readily possible to identify whether a crimp profile has already been used or not. For this purpose, it is either necessary to steadily control the quality of the crimped product and/or to apply expensive measurement tools to periodically investigate the crimp profiles of the crimping die inset in a time-consuming process.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

The present invention relates to an exchangeable crimping die insert for a crimping die for crimping electrical contact terminals to electrical cables. Preferably, the exchangeable crimping die insert is inserted in an automated crimping tool or crimping die used for mass production. But the exchangeable crimping die insert is not limited to the application in an automated crimping tool. It can also be used in hand crimping tools.

It is an object of the present invention to provide an exchangeable crimping die insert having two or more identical crimp profiles which overcomes the above outlined disadvantages at least partially. It is in particular an object of the present invention to provide an exchangeable crimping die insert which has an extended lifetime.

The exchangeable crimping die insert includes at least two essentially identical crimp profiles integrated in one part. It is of course possible that the exchangeable crimping die insert includes several different crimp profiles integrated in the one part, wherein each of the several different crimp profiles has at least one second essentially identical crimp profile.

Furthermore, the exchangeable crimping die insert includes at least one indicator to differentiate the at least two essentially identical crimp profiles. The indicator enables preferably a differentiation of the at least two essential identical crimp profiles with the naked eye.

The term "essentially identical" as used here and at other passages of this application means that crimp profiles are identical when leading to the same crimp quality when applied on the same components to be crimped.

An inventive exchangeable crimping die insert significantly extends the lifetime compared to a conventional crimping die insert. For example, a crimping die insert having two identical crimp profiles can double the lifetime compared to a state of the art crimping die insert. Simultaneously, the indicator avoids applying worn off or defective crimp profiles in a crimping process. The at least one indicator prevents this by reliably distinguishing between used and unused crimp profiles.

In a further aspect, the at least two essentially identical crimp profiles are arranged on opposite ends of the part.

This configuration requires only minimum constructive changes of the crimping die insert. At the same time, the second crimp profile hardly has an effect on the mechanical stability of the exchangeable crimping die insert compared to conventional crimping die inserts.

According to another aspect, the at least one indicator introduces an asymmetry in the exchangeable crimping die insert. In a beneficial aspect, the asymmetry is to be removed prior to using the at least one second crimp profile, and/or the exchangeable crimping die insert includes at least one permanent asymmetry.

A single permanent asymmetry is sufficient to distinguish between the at least two crimp profiles of an exchangeable crimping die insert. For example, a recess in one of the two long sides of the crimping die insert can be used to discriminate two essentially identical crimp profiles, and thus can act as an indicator. A convention may be used to at first apply the crimp profile which is opposite to the permanent asymmetry (the first crimp profile) and then switch to the crimp profile which is adjacent to the permanent asymmetry (the second crimp profile) after a predetermined number of crimp actions have been performed. This approach has the benefit that only a minimum modification of the crimping die insert is necessary. On the other hand, this configuration can only function in combination with the crimp die. It is a drawback of this approach that it is not possible to decide when considering a crimping die insert with a naked eye whether one or both of its crimp profiles have already been used or is even worn out.

If the crimping die insert has an asymmetry, which is to be removed prior to applying the at least one second crimp profile, this allows to recognize whether a crimping die insert has a fresh or an unused crimp profile or not.

In a preferred aspect, the exchangeable crimping die insert has two holes for a mechanical fastening of the exchangeable crimping die insert in the crimping die with respect to the at least two crimp profiles, and wherein at least one of the holes includes a least one indicator.

This kind of indicator requires no or almost no constructive modifications of the exchangeable crimping die insert. Additionally, it has the benefit that the indicator has to be removed prior to be able to apply the at least one second crimp profile for a crimping process. Thus, the removal of the at least one indicator cannot left behind. Furthermore, a design of crimping die inserts having two fastening holes enables to upgrade crimping tools or crimping dies in use with inventive crimping die inserts.

In a further preferred aspect, the at least one indicator includes an obstruction preventing using the hole for a mechanical fastening of the crimping die insert in the crimping die. In still another aspect, the obstruction includes a narrow ridge of crimping die insert material or a seal of plastic material which is to be removed prior to using the hole for the mechanical fastening of the crimping die insert in the crimping die.

Using a seal of, for example, plastic material requires no modification of the crimping die insert in order to introduce an indicator. Further, the plastic material can be designed to distinctively differentiate the two fastening holes of the crimping die insert. On the other hand, it requires the insertion of an additional part into each of the exchangeable crimping die inserts.

In a beneficial aspect, the at least one indicator introduces a removable asymmetry in an outer contour of the exchangeable crimping die insert.

The present asymmetry indicates that the crimping die insert has at least one crimp profile which has up to now not been used. Further, removing the asymmetry signalizes that a first crimp profile of the crimping die insert is worn out and the at least one second crimp profile should be used.

In an advantageous aspect, the at least one indicator includes a frame of a crimping die insert material around a recess, the frame is to be removed prior to using the crimp profile adjacent to the frame.

This configuration of an indicator does not touch functional elements of the crimping die insert. It neither concerns the at least two crimp profiles nor the holes used as fastening elements. Thus, any difficulties when removing the frame, as for example an incomplete removal of the frame, does not affect the function of the crimping die insert.

According to still a further aspect, the at least one indicator includes a barrier which at least partially disables an opening of the at least one second crimp profile, the barrier is to be removed prior to using the at least one second crimp profile.

It is an advantage of this configuration of an indicator that the barrier has to be removed prior to the usage of the at least one second crimp profile. As the barrier cannot be reestablished after being eliminated, it is obvious that the crimp profile has not yet been applied for a crimping process when the barrier is still present. On the other hand, it is necessary to carefully eliminate the barrier in order not to damage or even destroy the at least one second crimp profile.

In yet a further beneficial aspect, the barrier includes the crimping die insert material and has at least one predetermined frangible portion forming a breaking point to the crimping die.

This example of an indicator can be introduced when manufacturing the crimping die insert. The predetermined breaking point(s) can be produced in an automated process. Thus, it (they) can reproducibly be fabricated with high precision. This secures that the barrier breaks at the default position without essentially modifying the protected crimp profile.

According to still another aspect, ends of the crimping die insert having the at least two crimp profiles have a notch which is at least partially arranged across a width of the crimping die insert, and the at least one indicator includes a bar inserted into the notch to block the opening of the at least one second crimp profile.

In another preferred aspect, the at least one indicator additionally includes an indicator of some of the above indicated aspects.

The at least one indicator can include a combination of two or even more indicator. For example, the at least one indicator can include a first indicator in a hole or a fastening hole of the crimping die insert and a second indicator as a removable asymmetry of the outer contour of the crimping die insert. Further, it is also possible that the at least one indicator includes a third indicator, for example in form of a recess, apart from the above described first and second indicator.

It is to be noted that the minimum number of indicator is linked to the number of essentially identical crimp profiles integrated in one part of the crimping die insert. Generally, at least n−1 indicator are necessary for n essentially identical crimp profiles integrated in one part of a crimping die insert.

In still a further beneficial aspect, the exchangeable crimping die insert includes a central hole for the mechanical fastening of the crimping die insert in the crimping tool when using each of the at least two crimp profiles.

This configuration is advantageous, since it does not allow to install the crimping die insert out of position into the crimping die. Thus, this configuration excludes a damage of the terminal and/or the wire to be crimped or even of the crimping die by misarranging the crimping die insert. Exchangeable crimping die inserts having a single fastening hole may be beneficial for newly developed crimping dies.

According to still a further aspect, the exchangeable crimping die insert has a plate like shape including a metal or a metal alloy, the plate having at least one hole for a mechanical fastening of the exchangeable crimping die insert to the crimping die, the plate having a rectangular shape, the rectangle having a length to width ratio in a range of 2:1 to 10:1, and wherein the at least two crimp profiles are arranged on opposite broadsides of the rectangle. The thickness of an exchangeable crimping die insert depends on the thicknesses of the terminal and the wire to be joined in a crimping process.

Further, a crimping die may have two or more different exchangeable crimping die inserts, for example a first one to crimp first crimping vans of a terminal to a stripped wire and a second one to join second crimping vans with an isolation of the wire. An inventive crimping die insert may be used for both crimping processes.

Finally, in yet a further aspect, the exchangeable crimping die insert includes four crimp profiles arranged at four edges of the exchangeable crimping die insert and includes at least three indicator.

It will be appreciated that the number of essentially identical crimp profiles integrated in one part of a crimping die insert is not restricted to two. Rather, it is conceivable to design crimping die inserts having an arbitrary number of essentially identical crimp profiles in one part of a crimping die insert.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

In the following, the present invention will now be described in more detail hereinafter with reference to the accompanying figures, in which exemplary embodiments of the invention are illustrated. However, the present invention may be embodied in different forms and should not be construed as limited to the embodiments set forth herein. Rather, these examples are provided so that this disclosure will be thorough and will convey the scope of the invention to persons skilled in the art.

Figure 1:
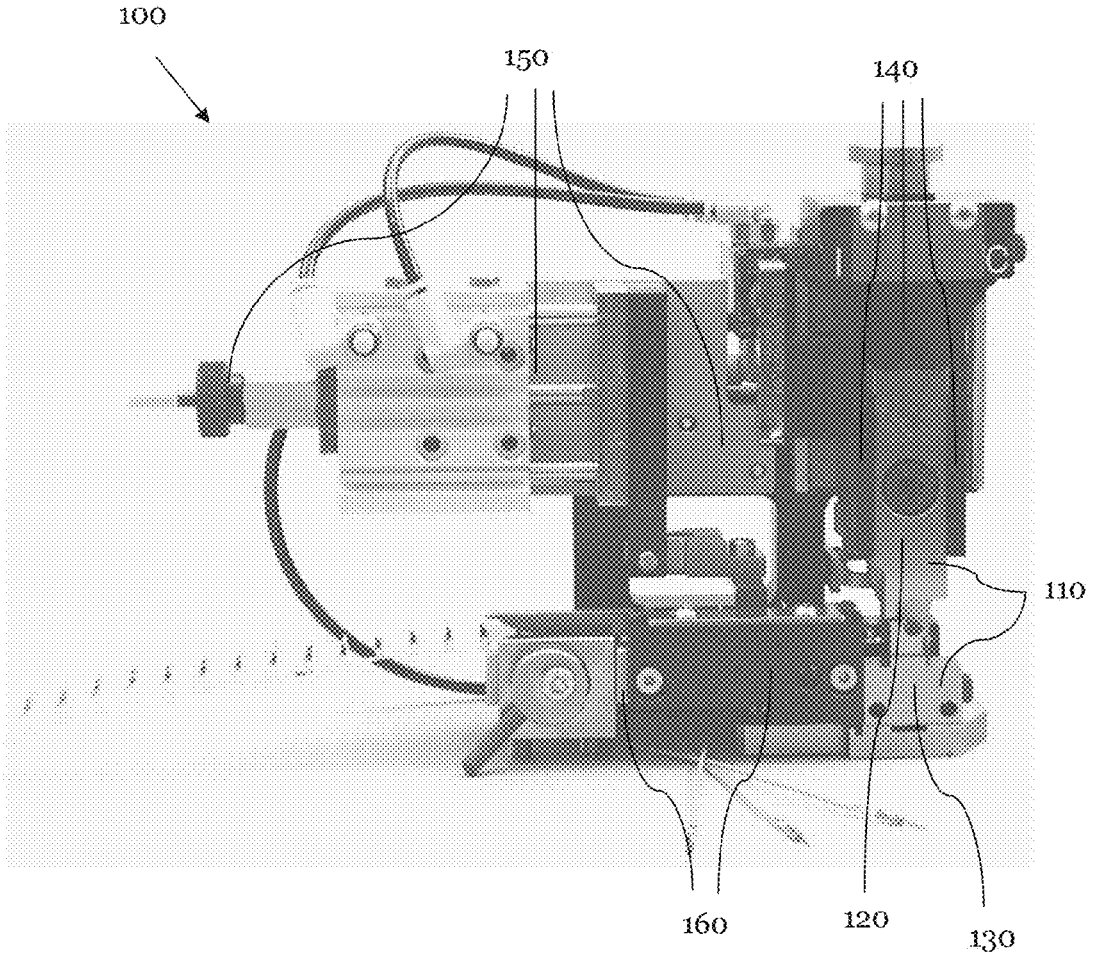
Fig. 1 (Prior Art)
FIG. 1 shows an example of a crimping die according to the prior art.

FIG. 1 represent a crimping die 100 or a crimping tool according to the prior art. The crimping die 100 contains an exchangeable crimping die kit 110 including an upper part 120 and a lower part 130.

Figure 2:
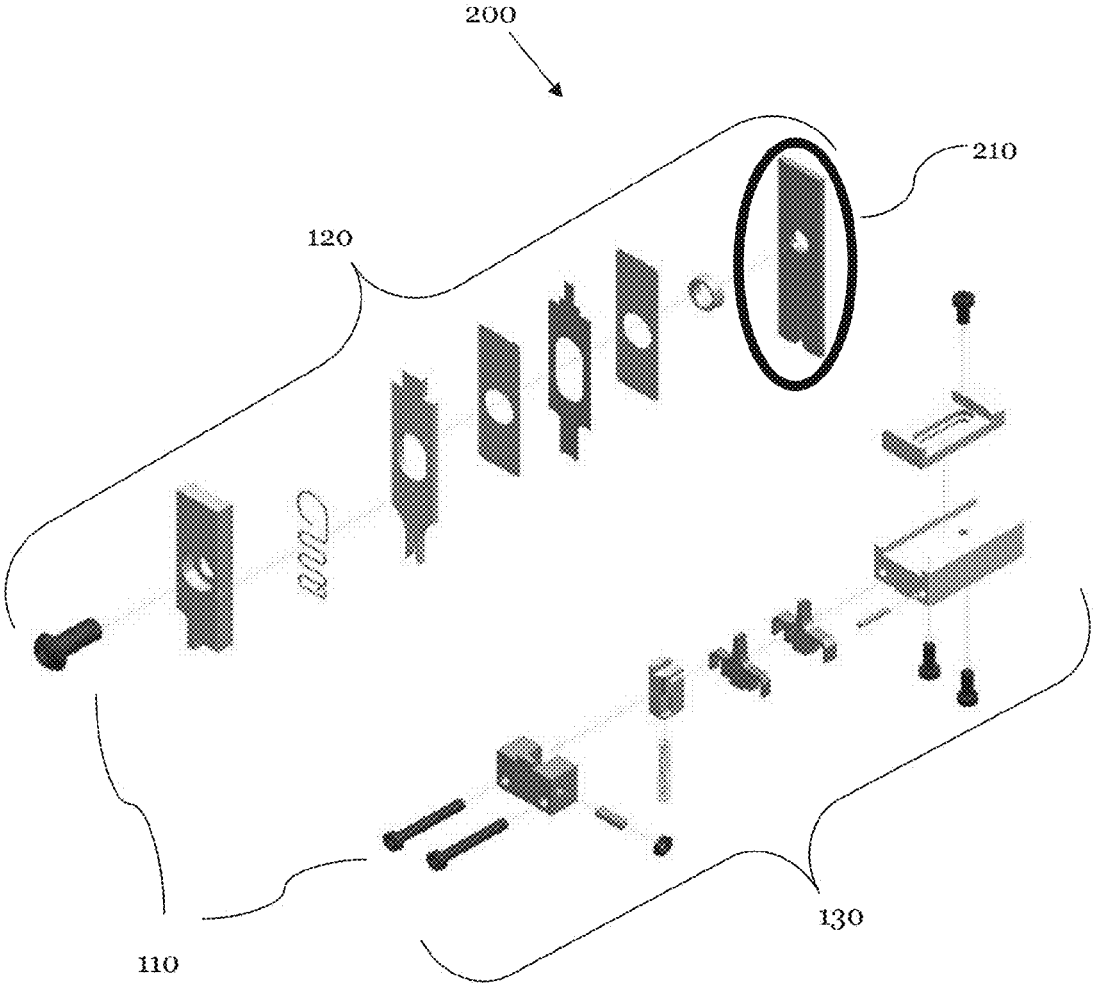
Fig. 2 (Prior Art)
FIG. 2 illustrates the parts of the crimping die of FIG. 1 according to the prior art.

The diagram 200 of FIG. 2 shows all essential components and the components layout of a complete crimping die kit 110. The upper part 120 of the crimping die kit 110 contains a crimping die insert 210 according to the prior art. A crimping die insert 210 is also called core plate. The crimping die insert 210 is the component of the crimping die insert 210 having the highest wear. Thus, this component is most often replaced of all components of the crimping die kit 110. The other components of the crimping die kit 110 are also subject to wear and are replaced when required. Preferably, the other components of the crimping die kit 110 are substituted when the crimping die insert 210 is replaced.

The components of the upper part 120 of the crimping die kit 110 are also denoted crimp jaw in the crimping die 100. The components of the lower part 130 of the crimping die kit 110 of FIG. 2 indicate the parts or components of a crimping anvil which are typically fixedly arranged to the crimping die 100. Both, the components of the upper part 120 and of the lower part 130 as well as the components layout applied for the crimping die insert 210 in use can also be used for the crimping die inserts exemplarily described in the following.

Again with respect to FIG. 1, the components of the upper part 120 represent the components of the crimping die kit 110 used to fasten the crimping die insert 210 in the pressure block 140 of the crimping die 100. The pressure block 140 is a movable part which moves the crimping die insert 210 towards the crimping anvil in order to perform a crimping process. The crimping die 100 further includes a feeding unit 150 and a feed table 160 both used to convey the terminals and the wires to the crimped between the anvil and the crimping die insert 210. The crimping die 100 may be inserted in an assembly machine.

In the following, crimping die inserts are described which are part of the upper part 120 of the crimping die kit 110 and are fixed to the pressure block 140 of the crimping die 100. It is also possible that inventive crimping die inserts are used in the lower part 130 of the crimping die kit 110, i.e. as part of an anvil. Furthermore, it is also conceivable to apply an inventive crimping die insert in both the upper 120 and the lower part 130 of the crimping die kit 110.

Figure 3:
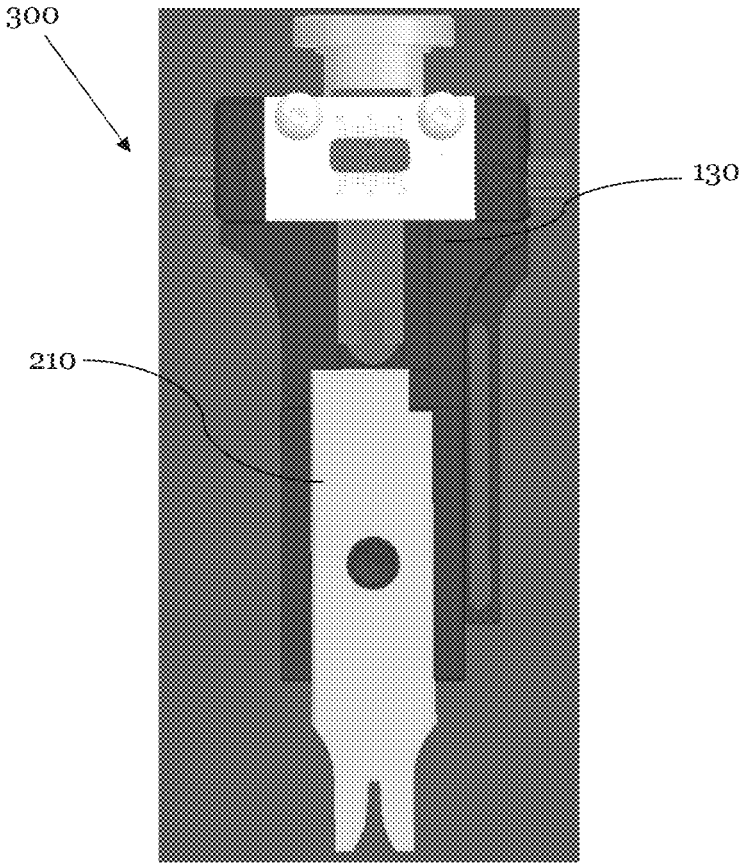
Fig. 3 (Prior Art)
FIG. 3 shows the pressure block of FIG. 1 according to the prior art.

The diagram 300 of FIG. 3 illustrates the pressure block 140 of the crimping die 100 of FIG. 1 and the crimping die insert 210 of FIG. 2. The crimping die insert 210 is arranged in the pressure block 140. The other components of the upper part 120 of the crimping die kit 110 are omitted in FIG. 3 as well as in the following figures for reasons of clarity. All of the crimping die inserts explained below can be installed in the pressure block 140 of a crimping die 100 without any modifications of this component.

Figure 4:
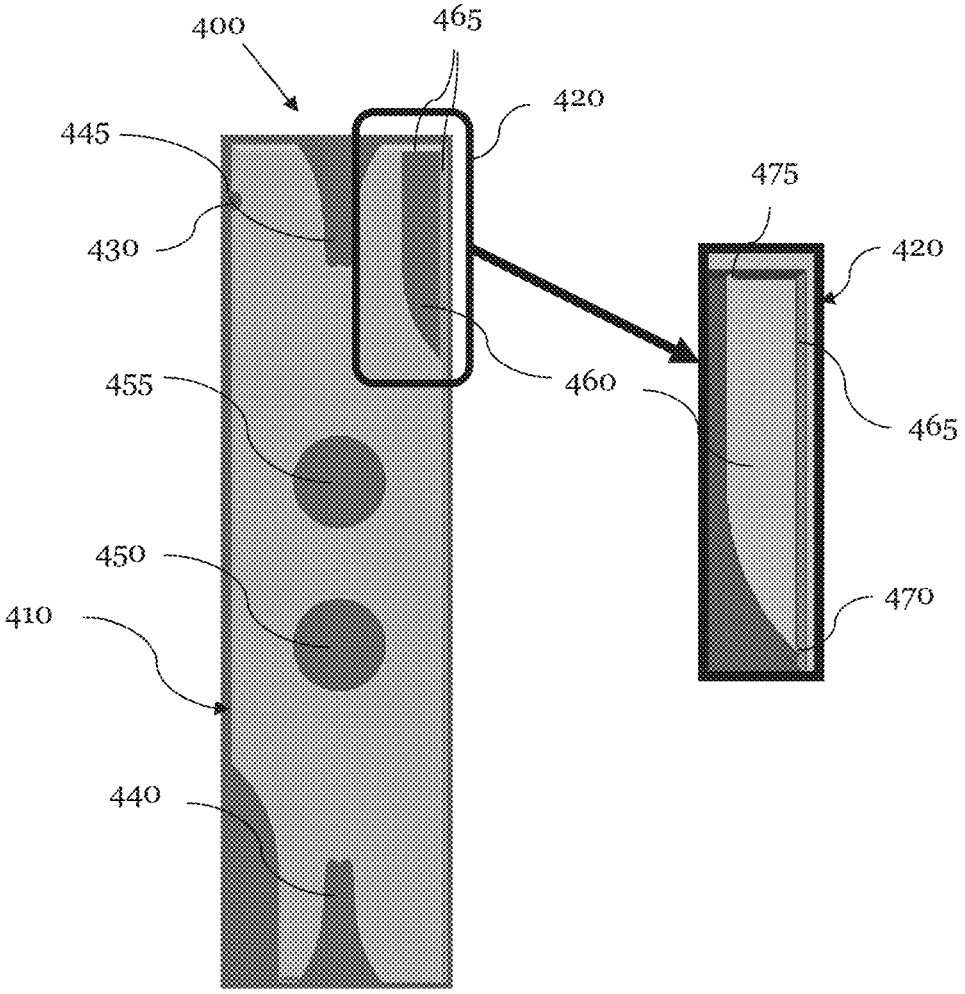
FIG. 4 illustrates a longitudinal section of a crimping die insert having two crimp profiles and having a frame around a recess according to one embodiment of the invention.

FIG. 4 depicts a diagram 400 including a crimping die insert 410 and an enlarged section 420 of the upper right corner of the crimping die insert 410. The crimping die insert 410 contains a first crimp profile 44*o* on its lower end and a second crimp profile 445 at its upper end. The crimp profiles 440 and 445 of the crimping die insert 410 are essentially identical. This also holds true for the crimping die inserts of the following figures.

In order to distinguish the two crimp profiles 440 and 445, the crimping die insert 410 has a frame 465 around the recess 460. Thus, the frame 465 acts as an indicator 465. The frame 465 can be generated when fabricating the crimp die from a blank. For example, the frame 465 can be formed by stamping or laser cutting. The frame 465 has two predetermined breaking points 470 and 475. The predetermined breaking points 470 and 475 are used to break the frame 465 in a defined manner. The frame 465 can manually be removed without the necessity to use a tool. On the other hand, it is also possible to use a tool, as for example a pliers, to remove the frame 465 from the crimping die insert 410.

Several alternatives are possible to define when the frame 465 is to be removed from the crimping die insert 410. The simplest rule is to break the frame 465 prior to using the adjacent crimp profile 445 for the first time.

Further, the crimping die insert 410 contains two holes 450 and 455 for fastening the crimping die insert 410 in the pressure block 140 of the crimping die 100 for performing crimp processes. For example, one or both holes 450 and 455 may be punched holes. As already mentioned in the previous section two holes 450 and 455 are necessary in order to fix the crimping die insert 410 in the crimping die 100 which are already in use. For using the crimp profile 440, the crimping die insert 410 is fixed in the crimping die 100 or the respective pressure block 140 via the upper hole 455. For performing crimping actions with the second crimp profile 445, the lower hole 450 is utilized for fastening the crimping die insert 410 in the pressure block 140.

Moreover, the crimping die insert 410 has a small permanent recess 430 at the upper left corner. As already discussed in the previous section, the permanent recess 430 alone can be used as an indicator 430 when a convention is established with respect to the sequence of the utilization of the crimp profiles 440, 445 regarding the recess 430.

Figure 5:
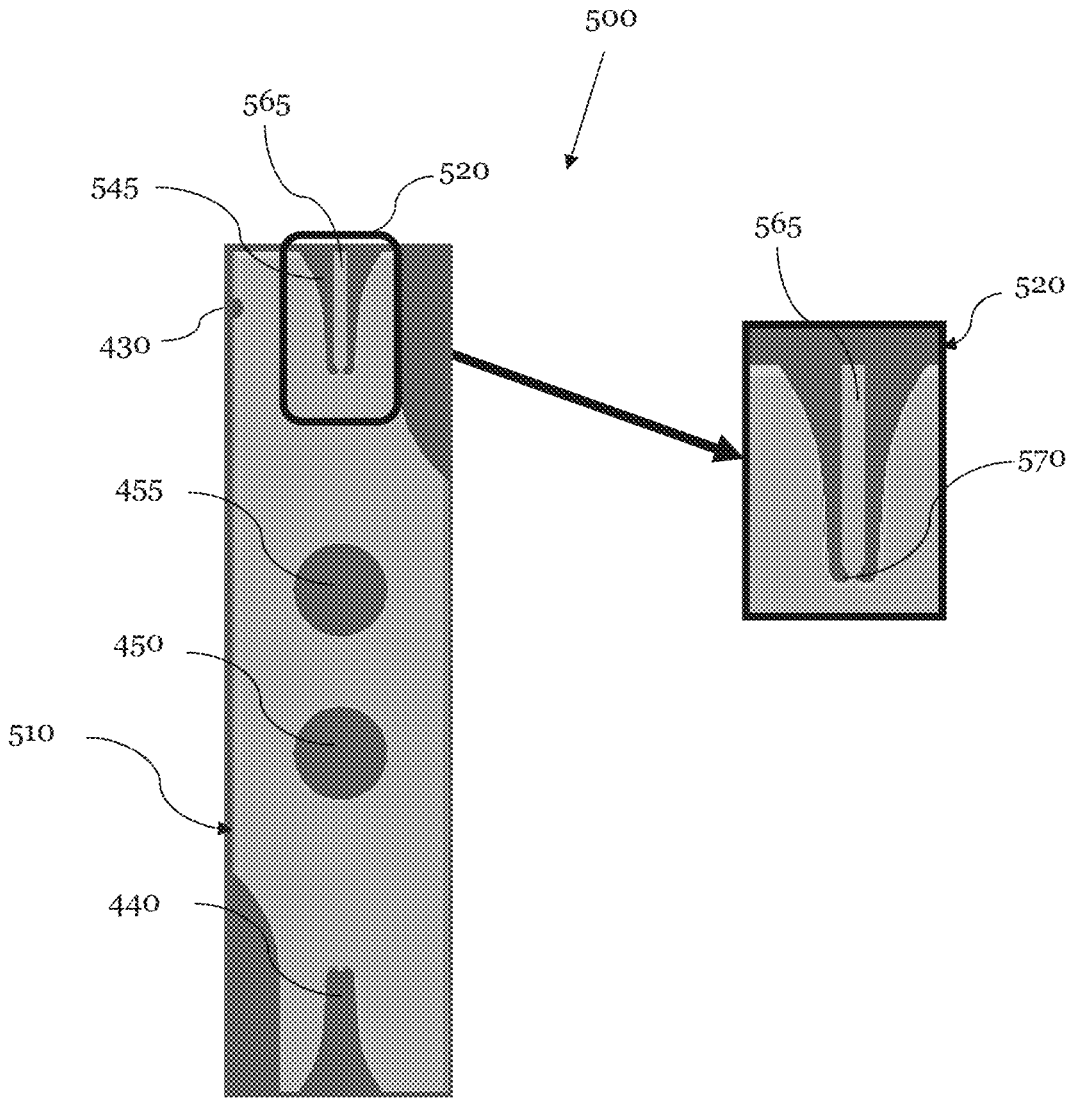
FIG. 5 shows a longitudinal section of a crimping die insert, wherein the second crimp profile includes a bar arranged in the longitudinal direction of the crimp profile according to one embodiment of the invention.

FIG. 5 represents a diagram 500 including a crimping die insert 510 and an enlarged section 520 of the upper middle part of the crimping die insert 510. Similar to FIG. 4, the crimping die insert 510 has a first crimp profile 44*o* on its lower end and a second crimp profile 545 at its upper end. The contours of the crimp profiles 440 and 545 of the crimping die insert 510 are essentially identical. But the second crimp profile 545 includes a thin bar 565 which is fixed to the bottom of the crimp profile 545 at its lower end. As can be recognized from the enlarged section 520, the bar 565 is connected to the crimping die insert 510 via a predetermined breaking point 570. The bar 565 blocks the utilization of the crimp profile 545, and therefore acts as an indicator 565. The presence of the bar 565 clearly indicates that the crimp profile 545 has not yet been used for a crimping process. As a consequence of the predetermined breaking point 570, the bar 565 can be removed from the crimp profile essentially without damaging the bottom of the crimp profile. Breaking the bar 565 can be performed manually or by applying a suitable tool, such as pliers.

Figure 6:
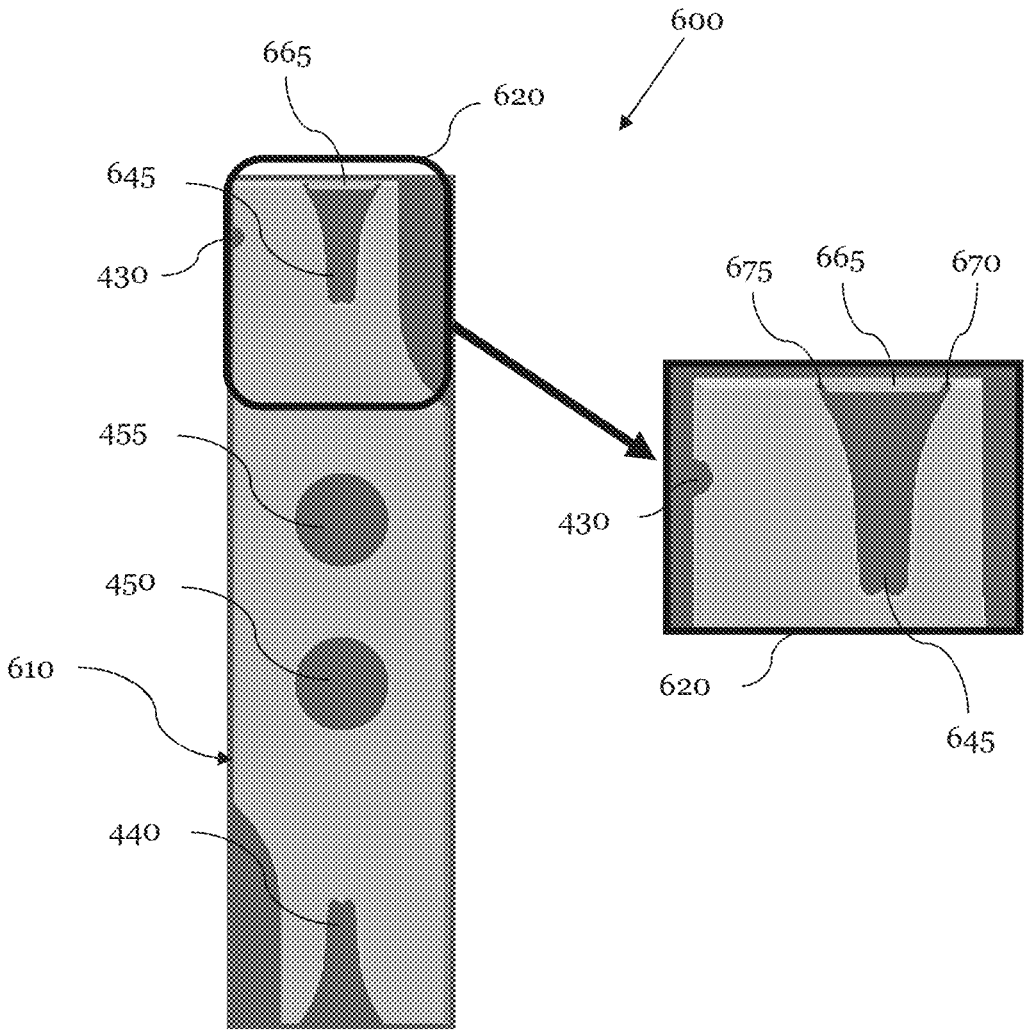
FIG. 6 illustrates a longitudinal section of a crimping die insert, wherein the second crimp profile is blocked by a tin bridge arranged at the upper end of the crimp profile according to one embodiment of the invention.

FIG. 6 illustrates a further example of an indicator 665 in form of a thin bridge preventing access to the crimp profile 645. The diagram 600 shows the crimping die insert 610 and an enlarged section 620 around the second or upper crimp profile 645. The blocking bridge 665 is connected to the upper end of the opening of the crimp profile 645 via the two predetermined breaking points 670 and 675. Similar to the diagram 500, the presence of the bridge 665 unambiguously signals that the crimp profile has up to now not been utilized. Again, the bridge 665 can easily be removed without essentially changing the opening of the crimp profile 645.

Figure 7:
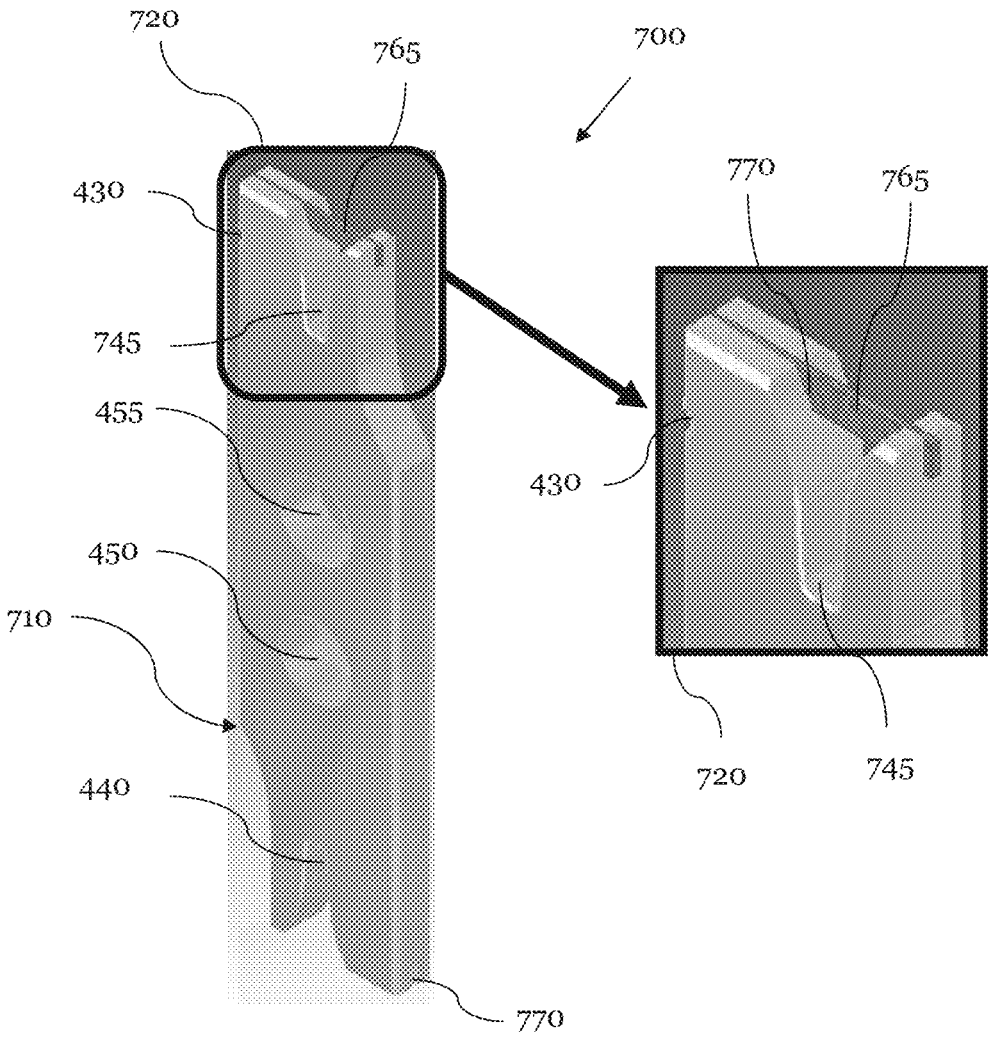
FIG. 7 shows a perspective view on a crimping die insert having two essentially identical crimp profiles, wherein each broad side has a notch with a bar according to one embodiment of the invention.

FIG. 7 shows a diagram 700 including a crimping die insert 710 and an enlarged section 720 of the upper part of the crimping die insert 710 in a perspective view. Similar to FIGS. 4 to 6 the crimping die insert 710 contains a first crimp profile 44*o* on its lower end and a second crimp profile 445 both having essentially identical profiles. The upper and the lower end of the crimping die insert 710 have a notch which extends in the example of FIG. 7 across the entire broad side of the crimping die insert 710. It is not necessary that both the upper and the lower end have a notch 770. Further, it is also not required that the notch 770 extends across the overall broad side. Moreover, the notch 770 may have an arbitrary shape, as for example rectangular, quadratic, triangular, or circular. In the example of FIG. 7, the notch 770 is essentially rectangular. A bar 765 having a shape fitting to the notch is inserted in at least one of the two notches 770.

If a bar 765 is inserted in each of the notches 770 it can be guaranteed that the crimping die insert 710 carrying both notches 770 has up to now not been used for crimping. A crimping die insert 710 having a bar 765 blocking one of the two crimp profiles indicates that the protected crimp profile is a fresh (i.e. unused) crimp profile. The bar 765 can manually be removed or by an appropriate tool prior to the utilization of the blocked or protected crimp profile 745.

Figure 8:
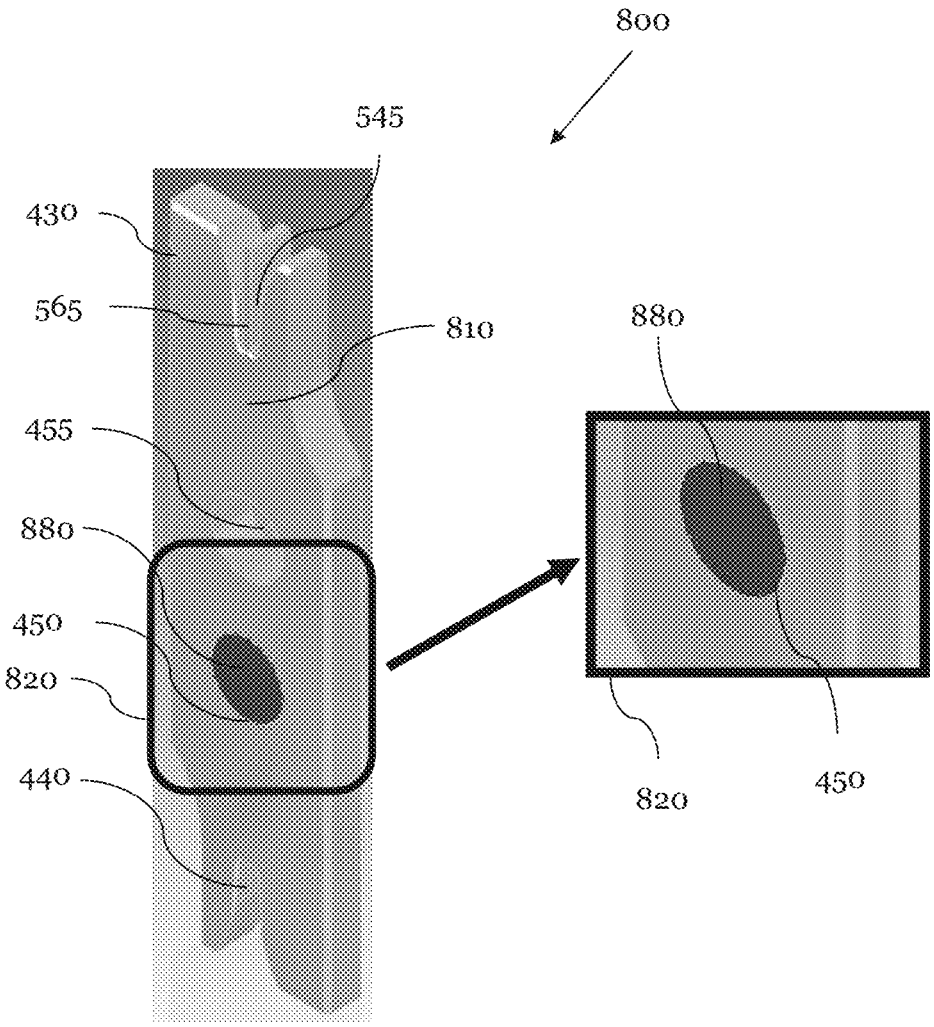
FIG. 8 illustrates the crimping die insert of FIG. 5, wherein one hole is covered with a seal of plastic material according to one embodiment of the invention.

FIG. 8 represents a diagram 800 including a crimping die insert 810 and an enlarged section 820 of a region around lower hole 450. The crimping die insert 810 has as an indicator 565 in form of the thin bar 565 of the crimping die insert 510 of FIG. 5. Additionally, the crimping die insert 810 has a seal 880 of plastic material as a second indicator 880. The seal 880 prevents that the crimping die insert 810 can incorrectly be installed in the pressure block 140 of the crimping die 100.

However, it is not necessary that the crimping die insert 810 has the first indicator 565, i.e. the thin bar 565 arranged in the crimp profile 545. The seal 880 is sufficient as an indicator 880. This is correct since the upper hole 455 is connected to the lower crimp profile 440 for a correct operation of the crimping die insert 810 in the crimping die 100. Using a seal 880 in one of the two holes 450 and 455 as an indicator 880 does not require any modification of the crimping die insert 810. It is of course also possible to apply two identical or different seals in both holes 450 and 455, for example seals having different colors.

Figure 9:
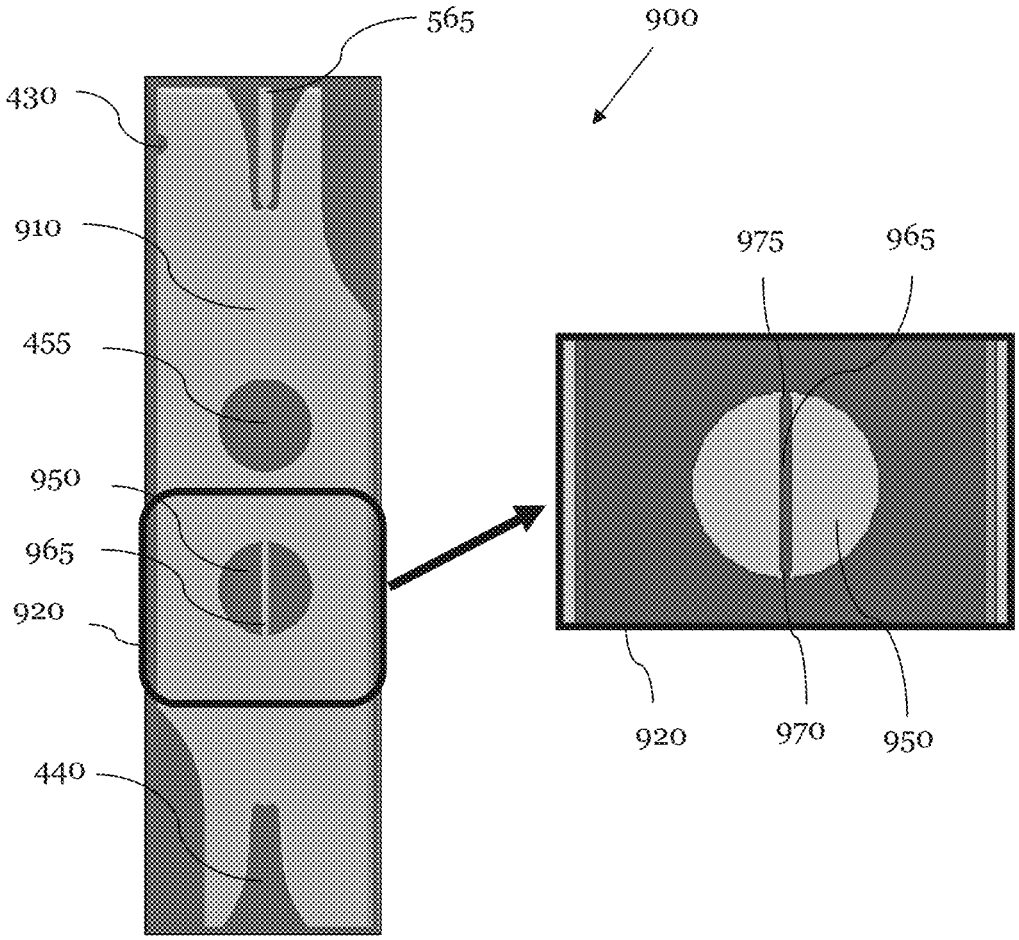
FIG. 9 shows a longitudinal section of a crimping die insert having two indicator, a first one of FIG. 5 and a second one in form of an obstruction of a hole according to one embodiment of the invention.

FIG. 9 illustrates a diagram 900 including a crimping die insert 910 and an enlarged section 920 of a region around a lower hole 950. The crimping die insert 910 represents the crimping die insert 510 of FIG. 5 with an additional indicator 965. The indicator 965 includes a bridge 965 bridging the lower hole 950. The bridge 965 is connected to the hole via the two predetermined breaking points 970 and 975. The predetermined breaking points 970 and 975 enables removing the bridge 965 from the hole 950 in a controlled manner either manually or by using an appropriate tool. As already discussed in the context of FIG. 8, the crimping die insert 910 includes two indicators 565 and 965. For a proper operation of the crimping die insert 910 one of them is enough (not shown in FIG. 9).

Figures 10A, 10B:
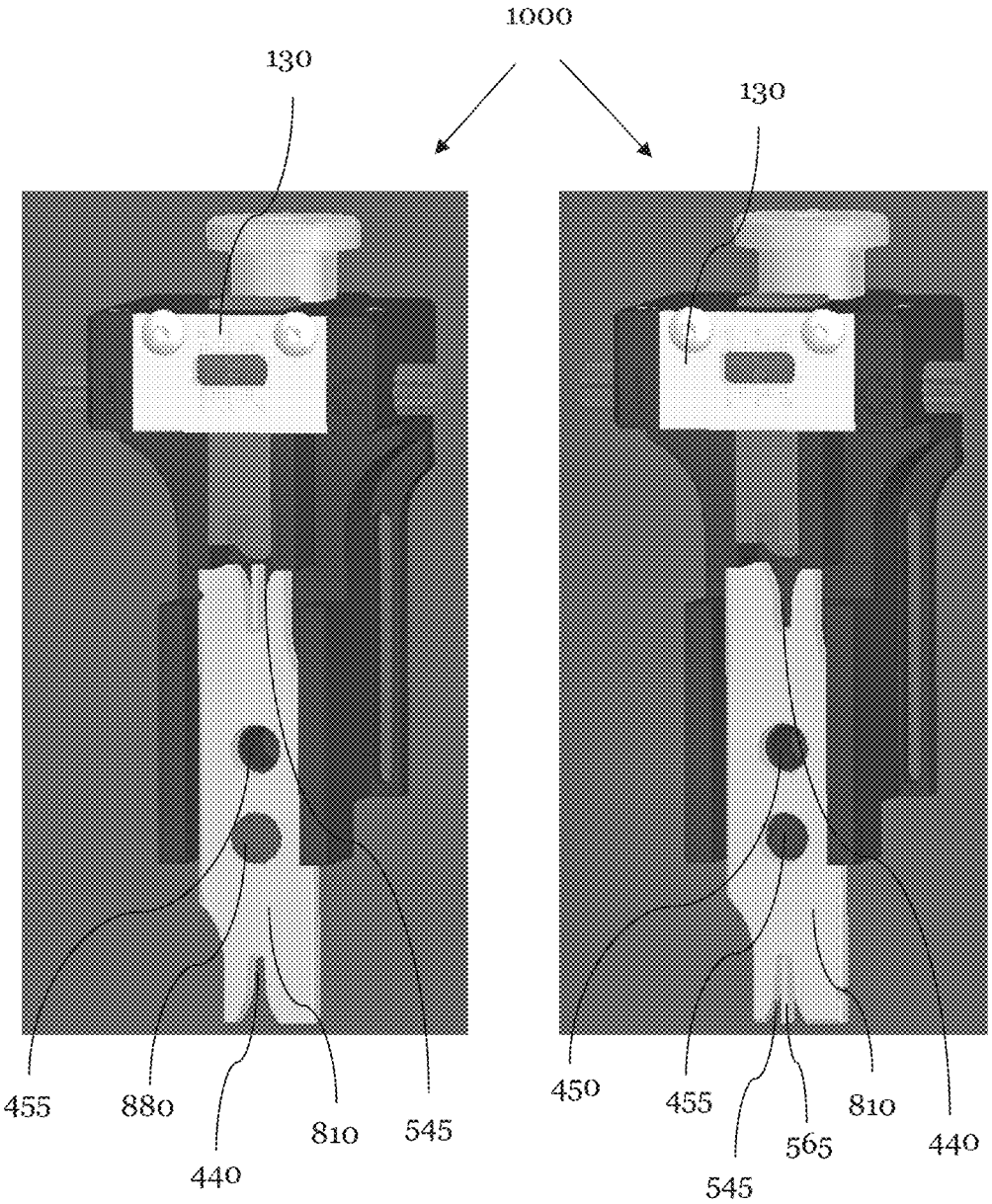
FIG. 10A illustrates the pressure block of FIG. 3 which has installed the crimping die insert of FIG. 8 for performing crimping actions with a first crimp profile according to one embodiment of the invention.
FIG. 10B illustrates the pressure block of FIG. 3 which has installed the crimping die insert of FIG. 8 for performing crimping processes with a second essentially crimp profile according to one embodiment of the invention.

Finally, the diagram 1000 of FIGS. 10A and 10B depict the crimping die insert 810 inserted in the pressure block 140 of the crimping die 100. FIG. 10A shows the installation of the crimping die insert 810 in a position for using the crimp profile 440 for a crimping process. The crimping die insert 810 is fastened via the hole 455 to the crimping die 100. FIG. 10B illustrates the configuration for preparing the usage of the crimp profile 545 for crimping. For this purpose, the seal 880 has been removed from the hole 450 and the crimping die insert 810 has been rotated 180° around an axis defined by the holes 450 and 455, and the crimping die insert 810 is fixed to the pressure block 140 via the hole or the fastening hole 450. As a last step, the bar 565 has to be removed from the crimp profile 545 prior to starting crimping operation using the crimp profile 545. This last step has not yet been performed in FIG. 10A.

As can be clearly recognized from FIGS. 10A and 10B, no modifications of the pressure block 140 or of the crimping die 100 are necessary in order to use any of the described crimping die inserts 410, 510, 610, 710, 810 and 910.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An exchangeable crimping die insert configured to be mechanically fastened within a crimping device configured to crimp electrical contact terminals to electrical cables, comprising:

a first crimping die defined in one end of the exchangeable crimping die insert and a second crimping die defined in an opposite end of the exchangeable crimping die insert, wherein the first and second crimping dies have essentially identical die profiles; and an indicator recess defined in an outer edge of the exchangeable crimping die insert configured to differentiate the first crimping die from the second crimping die, wherein the indicator recess is in closer proximity to the first crimping die than the second crimping die and wherein the indicator recess causes the exchangeable crimping die to be asymmetrical.

2. The exchangeable crimping die insert according to claim 1, wherein the exchangeable crimping die insert has a plate like shape.

3. The exchangeable crimping die insert according to claim 2, wherein the plate has a hole configured to mechanically fasten the exchangeable crimping die insert to the crimping device.

4. The exchangeable crimping die insert according to claim 2, wherein the plate having a rectangular shape having a length to width ratio in a range of 2:1 to 10:1.

5. An exchangeable crimping die insert configured to be mechanically fastened within a crimping device configured to crimp electrical contact terminals to electrical cables, comprising:

a first crimping die defined in one end of the exchangeable crimping die insert and a second crimping die defined in an opposite end of the exchangeable crimping die insert, wherein the first and second crimping dies have essentially identical die profiles;

a first hole and a second hole defined in a mesial portion of the exchangeable crimping die insert, each of first and second holes being configured to mechanically fasten the exchangeable crimping die insert in a crimping device, wherein the first hole and the second hole have the same diameter; and a removable indicator disposed within the second hole configured to differentiate the first crimping die from the second crimping die, wherein the removable indicator recess causes the exchangeable crimping die to be asymmetrical.

6. The exchangeable crimping die insert according to claim 5, wherein the removable indicator provides an obstruction that prevents using the second hole for the mechanical fastening of the exchangeable crimping die insert in the crimping device.

7. The exchangeable crimping die insert according to claim 6, wherein the removable indicator is a narrow ridge of crimping die insert material within the second hole which is configured to be removed prior to using the second hole for mechanically fastening the exchangeable crimping die insert in the crimping device.

8. The exchangeable crimping die insert according to claim 6, wherein the removable indicator is a removable plug formed of plastic material which is configured to be removed prior to using the second hole for mechanically fastening the exchangeable crimping die insert in the crimping device.

9. An exchangeable crimping die insert configured to be mechanically fastened within a crimping device configured to crimp electrical contact terminals to electrical cables, comprising:

a first crimping die defined in one end of the exchangeable crimping die insert and a second crimping die defined in an opposite end of the exchangeable crimping die insert, wherein the first and second crimping dies have essentially identical die profiles;

a first indicator recess defined in an outer edge of the exchangeable crimping die insert in closer proximity to the first crimping die than the second crimping die;

a second indicator recess defined in an outer edge of the exchangeable crimping die insert in closer proximity to the second crimping die than the first crimping die and diagonally arranged in the exchangeable crimping die insert from the first indicator recess; and a removable indicator disposed within the second indicator recess configured to differentiate the first crimping die from the second crimping die, wherein the removable indicator causes the exchangeable crimping die to be asymmetrical.

10. The exchangeable crimping die insert according to claim 9, wherein the removable indicator includes a frame formed of the same material as the exchangeable crimping die insert around the second indicator recess and wherein the frame is configured to be removed prior to mechanically fastening the exchangeable crimping die insert in the crimping device.

11. An exchangeable crimping die insert configured to be mechanically fastened within a crimping device configured to crimp electrical contact terminals to electrical cables, comprising:

a first crimping die defined in one end of the exchangeable crimping die insert and a second crimping die defined in an opposite end of the exchangeable crimping die insert, wherein the first and second crimping dies have essentially identical die profiles; and a removable indicator disposed within an opening of the second crimping die configured to be removed prior to using the second crimping die, wherein the removable indicator causes the exchangeable crimping die to be asymmetrical.

12. The exchangeable crimping die insert according to claim 11, wherein the removable indicator is formed of the same material as the exchangeable crimping die insert and has a predetermined frangible portion forming a breaking point from the exchangeable crimping die insert.

13. An exchangeable crimping die insert configured to be mechanically fastened within a crimping device configured to crimp electrical contact terminals to electrical cables, comprising:

a first crimping die defined in one end of the exchangeable crimping die insert and a second crimping die defined in an opposite end of the exchangeable crimping die insert, wherein the first and second crimping dies have essentially identical die profiles; and means for differentiating the first crimping die from the second crimping die, wherein the means for differentiating the first crimping die from the second crimping die causes the exchangeable crimping die to be asymmetrical.

* * * * *